United States Patent [19]

Takeuchi et al.

[11] 4,232,931

[45] Nov. 11, 1980

[54] CONNECTOR FOR COAXIAL CABLES

[75] Inventors: Takeshi Takeuchi; Takao Terasawa, both of Yokohama, Japan

[73] Assignee: Hochiki Corporation, Tokyo, Japan

[21] Appl. No.: 970,950

[22] Filed: Dec. 19, 1978

[51] Int. Cl.[3] ..... H01R 11/22

[52] U.S. Cl. ..... 339/258 R

[58] Field of Search ..... 339/258, 256, 259

[56] References Cited

U.S. PATENT DOCUMENTS 4,152,042 5/1979 Ostapovitch ..... 339/258 R

*Primary Examiner*—Roy Lake
*Assistant Examiner*—DeWalden W. Jones
*Attorney, Agent, or Firm*—Jordan and Hamburg

[57] ABSTRACT

A connector for connecting coaxial cables includes an axial extending wall member having a first element folded over on itself to form a fold defining one terminating end of the wall member, the wall member having a first section defined by opposed and abutting portions and extending from the fold to a second section, the second section extending from the first section to the other terminating end of the wall member. The opposed and spaced portions of the second section has a first lip between which the coaxial cable passes, and also has generally parallel side edges. A pair of elements are disposed generally perpendicular to the opposed and spaced portions of the second section, the pair of elements each having a first part disposed on the side edges and a second part extending axially beyond the other terminating end of the wall member, the second part of the pair of elements being spaced from one another and having a second lip between which the coaxial cable passes, the second lip being axially spaced from the first lip.

11 Claims, 7 Drawing Figures

CONNECTOR FOR COAXIAL CABLES

BACKGROUND OF THE INVENTION

The present invention relates to a connector for electrically connecting coaxial cables and, more particularly, to a receptacle capable of electrically connecting cable conductors of a large variety of different diameters, including those of coaxial cables of large current capacity (usually 3A or larger) and small current capacity (usually up to 3A).

The reliability of a system constituted by coaxial cables which inherently has a good transmitting characteristic is largely affected by the reliability of a number of connectors used in the system for connecting these coaxial cables. From this point of view, research and development of technics for improving the reliability of these connectors have a substantial significance.

In practical design of the system making use of the coaxial cables, coaxial cables having cable conductors of suitable diameters are selected from a group of commercially available coaxial cables having cable conductors of diameters which differ over a wide range of between 0.5 mm and 1.8 mm, in accordance with the difference of the current capacities. It is therefore necessary, in order to obtain a sufficiently high reliability of the system, to develop a new receptacle which can accomodate itself to the difference of diameters of cable conductors which are usually 0.5 mm to 2 mm.

Under this circumstance, F type or FN type connectors have been developed for connecting coaxial cables of current capacity of up to 3A, while fitting type connector has been developed for use in combination with coaxial cables having current capacity exceeding 3A, and these connectors have been selectively used in accordance with the condition of use.

Thus, the fitting type connector is used when a relatively large current capacity is required at the connection. This type of connector is fixed by at first inserting the cable conductor into the electric device and then pressing the cable conductor onto the fitting seat by means of screws. Accordingly, the attaching of this type of connector requires a troublesome work of unsealing of the electric device and the pressing of the cable conductor by means of screws.

In case of a female receptacle, which is adapted to be incorporated in the electronic device or in the connector as in the case of the fitting seat, the cable conductor or a contact pin connected to the cable conductor is directly inserted into the device from the outside of the latter, so as to accomplish the required electric connection. Thus, the troublesome task of unsealing the electric device is conveniently eliminated by the use of this female receptacle so that the connection can be accomplished very easily.

In order to enjoy the described merit of the female receptacle in general cases, however, it is necessary that the female receptacle has advantages equivalent to those offered by the fitting seat, i.e. the stability against mechanical vibration or oscillation, increment of the current capacity and the accommodation or adaptation to the difference of diameters of cable conductors. Further, in order that the receptacle satisfy these requirements, the spatial dimension allotted to the receptacle is as small as 30 mm in axial length and $3\times3$ mm$^2$ in cross-sectional area. The restriction imposed on the mechanical processing of constituents of the receptacle which is to be accommodated by such a limited space is extremely severe. Any excessive construction deteriorates the practicability. It is therefore necessary to develop a receptacle having a novel construction over the prior art which can fulfill the above-stated requirements.

The specification of U.S. Pat. No. 3,838,388 discloses a branch-type contact which is characterized by having opposing resilient arms for obtaining a contact pressure, in which a pair of parallel recesses extending in the axial direction and curved in the cross-sectional direction of the resilient arms are formed. At the same time, a resilient retaining member is disposed between two branches and bent in the direction opposite to the direction of contact, so that the resilient retaining member may appear between the branches when the contact is attached to a terminal block. This retaining member, however, has no function of making electric contact with the cable conductor or contact pin, because it does not exert any clamping force.

The pair of resilient arms having parallel recesses, disposed such that these recesses oppose each other, is advantageous in that they provide a recessed guide space for guiding the male pin when the latter is inserted. The increment of the contact pressure on the male pin, offered by the curvature of the recesses is, however, rather incompatible with the adaptability of the receptacle to the variation of sizes of coaxial cables with which the present invention is concerned.

Namely, a reinforcing structure having a pair of parallel recesses of, for example, 3 mm wide formed over the entire length of the linearly declining resilient arms. However, this reinforcing structure on the other hand narrows the range of resilient deformation of the arms, resulting in poor adaptability to the variation of size of the male contact.

SUMMARY OF THE INVENTION

It is therefore an object of the invention to obtain a shape of the contact arm member which can preserve the restoring force over a long period of time and increase the range of resilient deformation.

It is another object of the invention to construct, in the aforementioned limited space, a receptacle having a pair of contact regions for contact with the male contact, i.e. a contact region for contacting the male contact in the horizontal direction and a contact region for contacting the same in the vertical direction, in order to enhance the stability of the electrical connection against externally caused vibration.

It is still another object of the invention to provide a reasonable construction in which the members constituting the receptacle accommodated in the limited space are made of thin web materials, so that the posture of the receptacle may be stabilized against the insertion of the male contact.

To these ends, according to the invention, there is provided a connector for connecting coaxial cables, having a receptacle which comprises: a pair of projecting lip portions including opposing vertical lip bases standing at both sides of the end of axial wall members, horizontal regions extending horizontally from respective lip bases, curved or inclined regions extending forwardly from the horizontal regions toward each other in the horizontal direction and constituting, at their horizontal approaching apices, a first contact region, and a receiving opening region formed by spreading the extreme ends of the first contact region away from each other; and a second lip formed by folding the rear end of the axial wall members to have a length extending between a folded neutral base and the opposing vertical lip bases; wherein the second lip has a second contact region constituted by its end directed toward the first contact region, in cooperation with the end portions of the axial wall members, the second contact region of the second lip including a vertical approaching apices which extend vertically, i.e. at a right angle to the aforementioned approaching apices of the first contact region which spreads horizontally.

In order that the first and the second contact regions of the receptacle, which are formed in the limited standard space of 3×3×30 mm, may have a sufficient restoring force and contact pressure, it is essential to equalize the axial lengths of the vertical lip bases 3,5 and the projecting lips 4,6 to equalize the entire length of the lips to the axial length of the superposed rear end portion *2b,7b,* and to equalize the lengths of the horizontal portion *4a* and the curved or inclined portion *4b.* These relationships concerning the lengths are suitably corrected in accordance with the kind of material used, e.g. phosphor bronze, beryllium copper or the like, thickness of the material, dimension of the accommodation space which may be changed from a standard size, and other conditions.

DESCRIPTION OF THE PREFERRED EMBODIMENTS

Figure 1:
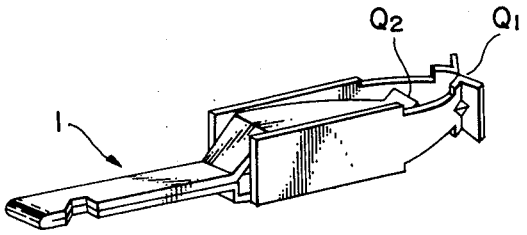
FIG. 1 is a schematic illustration of a receptacle in accordance with the invention.

Referring first to FIGS. 1 to 5, a receptacle in accordance with the invention, generally designated at a reference numeral 1, has an axial wall member 2. A pair of vertical lip bases 3, 5 are formed at respective sides of the axial wall member 2, so as to oppose each other, thereby to impart rigidity to the axial wall member 2. At the same time, the vertical lip bases 3,5 stably hold the resilient deformation of projecting lips 4,6 which extend forwardly from respective lip bases 3, 5.

The prodecting lips have horizontal portions *4a,6a* extending horizontally from the lip bases, curved portions *4b,6b* or inclined portions *4b',6b'* extending forwardly from the horizontal portions and approaching each other, a first contact region Q1 constituted by their most approaching apices *4c,6c,* and receiving opening portion *4d,6d* formed by spreading the outer ends of the first contact region Q1 from each other.

Figure 6:
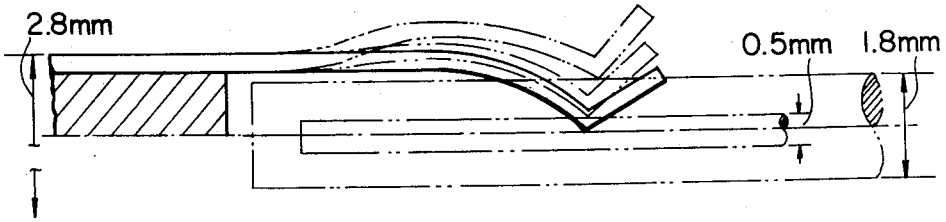
FIG. 6 is an enlarged view of the projecting lip portion of the receptacle as shown in FIG. 2, specifically showing how it is deformed when it receives various sizes of the cable conductor or male pin.
Figure 2:
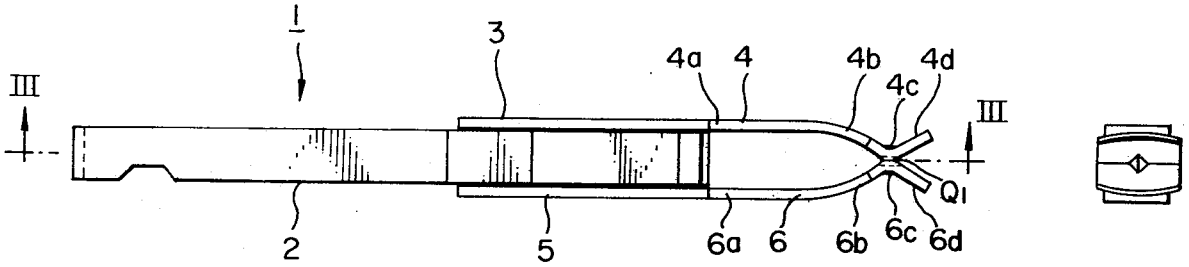
FIG. 2 is a side elevational view of the receptacle as shown in FIG. 1.
Figure 3:
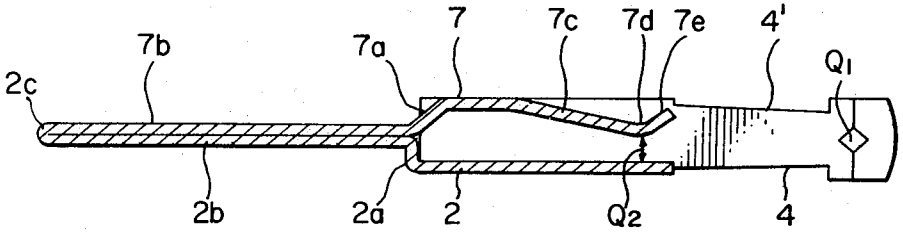
FIG. 3 is a sectional view taken along the line III—III of FIG. 2.
Figure 4:
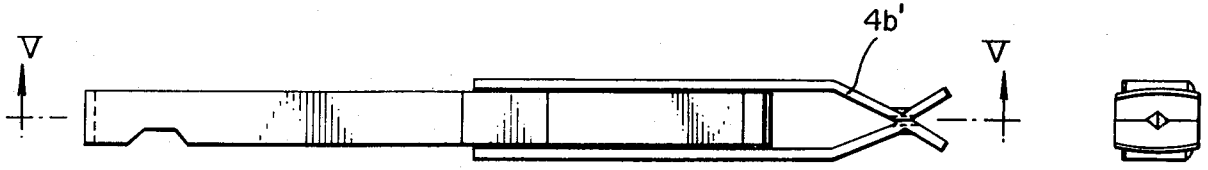
FIG. 4 is a side elevational view of another receptacle.
Figure 5:
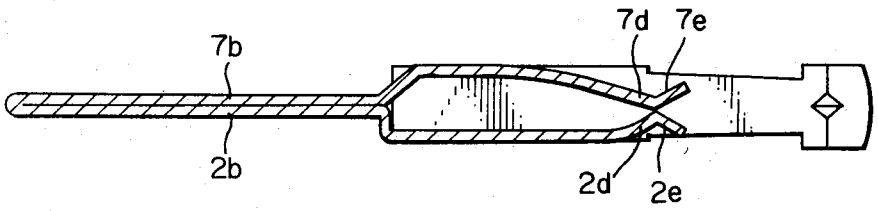
FIG. 5 is a sectional view taken along the line IV—IV of FIG. 4.

According to this construction, the pair of vertical lip bases which imparts a rigidity to the axial wall member 2 simultaneously support the projecting lips stably, so that it is possible to extract the projecting lips horizontally, i.e. without giving any substantial inclination, from the lip bases. When the cable conductor or male pin of the coaxial cable is inserted into the first contact region Q1, the horizontal portions *4a,6a* are deflected resiliently, so that the curved portions *4b,6b* are deformed to exhibit larger radius of curvature. Alternatively, in case of the embodiment as shown in FIG. 6, the inclined portions *4b',6b'* of the projecting lip are deflected to have a larger angle of inclination.

This two kinds of deflection or deformation, which take place simultaneously in the projecting lips 4,6, are highly effective to the improvement of the durability against the deformation, i.e. to the preservation of the restoring force. In this connection, it is to be pointed out that a simple deflection is caused in each of the resilient arm member over the entire length of the latter, or alternatively, the opening deformation of the folded intermediate portion is utilized for making the arm members oppose each other. The arrangement in accordance with the invention can provide a much superior resilient force, as well as a longer preservation of the restoring force, as compared with a conventional structure. Consequently, it becomes possible to connect a cable conductor or male pin which has a large diameter well reaching 70 to 80 percent of the distance between the vertical lips 3,5 or the breadth of the axial wall member 2. This means the efficiency of the use of the limited space is remarkably improved.

The construction incorporating two vertical lip bases 3,5, which affords superior restoring and resilient force through two sorts of deformation connected in series in the axial direction, on the other hand allows to provide a vertical second contact region Q2 in the receptacle 1.

This second contact region has vertical contact area which can be opened and closed in the horizontal direction, in contrast to the first contact region having a horizontal contact area which can be opened and closed in the vertical direction. Consequently, the cable conductor or the male pin inserted into the receptacle is resiliently restrained in both of horizontal and vertical directions, so as to be held stably against the externally-caused vibration.

To this end, the rear end portion of the axial wall member 2 extending rearwardly from the vertical lip bases is bent at the neutral base portion *2c,* so that the second lip 7 may be positioned between the opposing vertical lip bases 3,5. The second lip 7 thus constructed can exhibit a smooth resilient deformation, because it can have a sufficiently large length in the limited space between the second contact region Q2 and the neutral base portion *2c.*

An auxiliary bend *2a* which is formed by bending the wall member 2 at the rear end of the vertical lip bases 3,5, such that the rear end portion *2b* is axially aligned with the axis of the receptacle 1, conveniently increases the rigidity of the vertical lip bases which constitute the core of the receptacle 1. At the same time, the position of contact by the second contact region can be adjusted by changing the height of the bend *2a.*

As the rear end of the lip 7 is superposed to the rear end portion *2b* of the wall member 2, the connection of the electric wire to this superposed rear end can be highly stabilized.

According to this arrangement, the second lip 7 is positioned out of the axis through a floating section *7a* opposing the bend *2a,* and has an inclined portion *7c* from the front end of which extended is a vertical contact section *7d* which cooperates with the wall member 2 in defining a second contact region Q2. The front end of the vertical contact section 7*d* is bent outwardly, so as to form a second receiving opening. In this construction, the position of contact performed by the second contact region Q2 is located at the side of the axis closer to the wall member 2.

The contact performed by the first contact region Q1 is sufficient for the small-diameter cable conductor of a coaxial cable of small current capacity. When a large-diameter cable conductor of a coaxial cable of large current capacity is connected to the first and second contact regions, the aforementioned eccentricity does not cause a substantial problem.

In order that the receptacle of the invention may have a general adaptability to the conventional fitting type connectors and F type connectors, an intermediate male pin may be used. In such a case, the aforementioned eccentricity of the second contact region Q2 is preferably avoided. To cope with this demand, the end of the axial wall member 2 is severed from the vertical lip bases 3,5, so as to form a float type contact section 2*d* and a receiving opening 2*e*. Most preferably, the first and the second contact regions Q1,Q2, as well as the superposed rear end 2*b*,7*b* are axially aligned with one another.

A test was conducted with a receptacle 1 in accordance with the invention. The receptacle 1 used in this test had an axial length of the receiving opening 4*d* of 4 mm, axial length of curved portion 4*b* of 3 mm, axial length of the horizontal portion 4*a* of 3 mm, axial length of the lip base of 8.6 mm, axial length of the rear end portion of 14 mm, breadth of the lip of 2.4 mm, and a thickness of 0.3 mm. Phosphor bronze was used as the material. This receptacle showed a contact pressure of 3 g which was confirmed materially constant over the various diameters of cable conductors of 0.6 mm to 1.8 mm. Thus, according to the invention, the contact pressure can be increased by 30 to 50 %, as compared with that of the conventional receptacle having resilient arms, and, in some cases, a contact pressure which is two times as large as that of the conventional receptacle can be obtained.

The form of the projecting lips 4,6 having horizontal portions 4*a*,6*a*, and curved or inclined portions 4*b*,6*b* or 4*b*',6*b*' can sufficiently improve the restoring and resilient contacting forces. In order to increase the flexibility as desired, the projecting lips 4,6 may be notched at their sides, as at 4',6'. This notch can adjustingly absorb the change in resiliency of the lips attributable to the change in kind of material and thickness of the lips.

Further, it is preferred to form a V-corss-sectioned valleys 4*c*',6*c*', having a depth smaller than the minimum diameter of the adoptable cable conductor, e.g. smaller than 0.5 mm, at the bent apices of the contact region Q1 or Q2. In such a case, the valley preferably has a breadth which is larger than the maximum diameter of the adoptable cable conductor, which is usually 1.8 mm, so that the cable conductor may stably be held by the two walls of the V-cross-sectioned valley.

The horizontal portions 4*a*,6*a* which are extended horizontally from the vertical lip bases 3,5 mean that the external spaces can be diminished by the use of the receptacle 1 of the invention. Thus, if there is any room or margin in the external space, it is possible to impart an angle corresponding to such a margin, to the horizontal portion. Since it is desirable to diminish the space of installation of the receptacle 1, the external space is naturally diminished, and the horizontal section or portions 4*a*,6*a* are formed from this point of view.

As a cable conductor of a coaxial cable or a male contact is inserted through the receiving opening 4*d*,6*d* or 7*e*,2*e* of the receptacle 1, a deflection is caused in each of the horizontal portions 4*a*,6*a*. Thus, the cable conductor or the male pin can open and pass the first contact region Q1, if its diameter is small enough, without causing in the curved or inclined portions 4*b*,6*b* or 4*b*',6*b*' any substantial deformation which would cause a large change in the curvature or angle of inclination. Since the pair of approaching apices 4*c*,6*c* extend horizontally and transversely of the axis, the cable conductor or the male pin is restrained from vertical movement relatively to the axis. Similarly, since the approaching apices 7*d*,2*d* of the second contact region Q2 have vertical contacting areas which extend transversely of the first-mentioned approaching apices 4*c*,6*c*, the cable conductor or the male pin inserted into the second contact region through the receiving opening 7*e*,2*e* is prevented from moving in the lateral or horizontal direction. Consequently, the cable conductor or male pin is stably held in both of horizontal and vertical directions, against any externally-caused vibration.

If the cable conductor or the male pin has a larger diameter of, for example, 1.8 mm, it opens and passes the first contact region Q1 simultaneously causing the deflection of the horizontal portions 4*b*,6*b* and the opening deformation of the curved or inclined portions 4*b*,6*b* or 4*b*',6*b*' which would increase the curvature or the angle of inclination. Since the opening deformation which takes place in the curved or inclined portion tends to displace slightly and forwardly and cable conductor or the male pin inserted into the gap between the approaching apices 4*c*,6*c*, the displacement of the projecting lips 4,6 as a whole toward the outside is conveniently diminished, so that no deviation corresponding to the diameter of the cable connector or the male pin does not ake place.

As will be seen from FIG. 6, a major advantage offered by the receptacle 1 of the invention is that the external space which has to be reserved for the use of the receptacle 1 is diminished.

Figure 7:
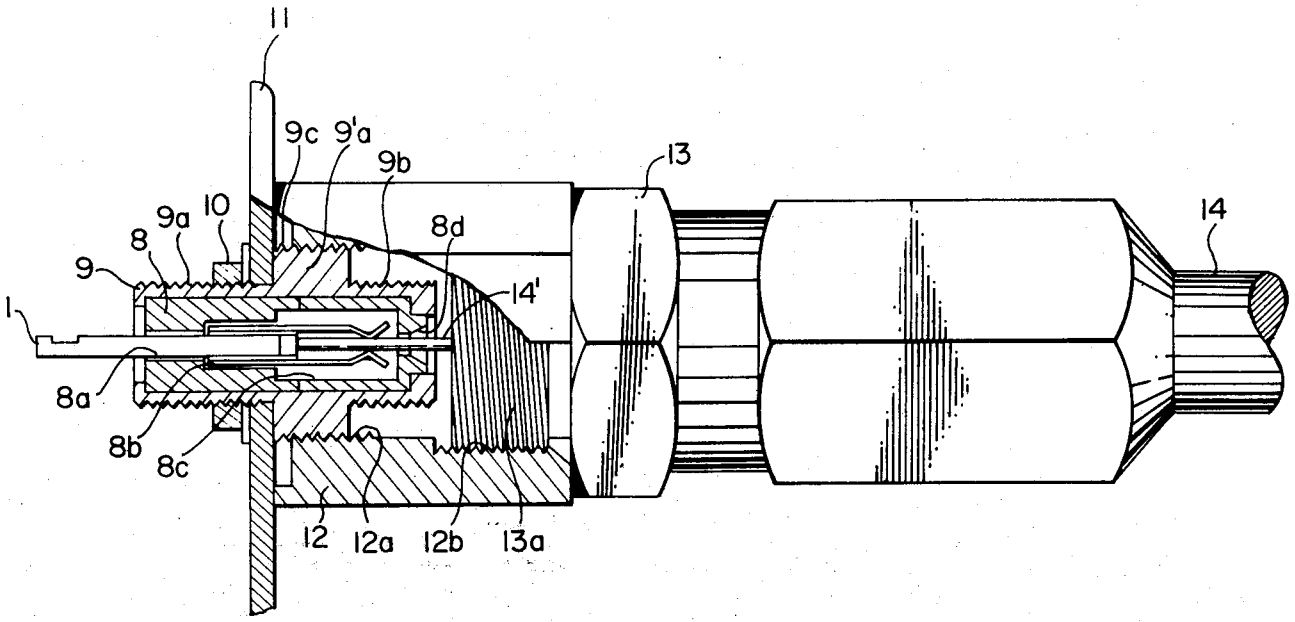
FIG. 7 is a partial sectional view of a fitting type connector showing the state thereof when it is connected to the receptacle.

Consequently, the size of the insulating sleeve by which the receptacle 1 is accommodated and insulated can conveniently be reduced. Referring now to FIG. 7, the insulating sleeve 8 has a rectangular rear end opening 8*a* which receives the superposed rear end portion 2*b*,7*b* of the receptacle 1, so as to prevent the latter from rotating. At the same time, the vertical lip bases 3,5 are received by an intermediate bore 8*b*, such that the edges of the edges of the vertical lip bases abut the step between the intermediate bore 8*b* and the rear end opening 8*a*. A front end opening 8*c* of the sleeve 8*c*, having a diameter larger than that of the intermediate bore 8*b*, receives the projecting lips 4,6 and the second lip 7, so as to allow free deformation of the latter. The end of the front end bore 8*c* is restricted to form a guide bore 8*d* through which the cable conductor 14' of a coaxial cable 14 is inserted into the receptacle 1.

In order to prevent the projecting lips 4,6 of the receptacle 1 from being expanded by other member such as a small rod or the like than the cable conductor, the guide opening restricts the upperlimit of the diameter of the member insertable into the receptacle 1. In such a case, the insulating sleeve 8 may have a split construction having a split surface which passes through the front end bore 8*c*.

A plug 9 receiving the insulating sleeve 8 has a large-diameter flange portion 9'. This flange 9' and a nut 10 screwed into a rear threaded portion 9a cooperate with each other in cramping therebetween a wall 11 of the device, so as to fix the receptacle 1. Threaded portion 9b at the end of the plug 9 is so threaded as to correspond to the female screw of the commercially available F or FN type connector. A thread 9c formed in the outer peripheral surface of the flange portion 9' is adapted to engage a first female screw 12a formed in an adapter 12. The adapter 12 further has a female screw 12b which matches the male or external screw 13a of commercially available fitting type connector 13.

Consequently, it becomes possible to connect the fitting type connector 13, which is usually used for connecting a coaxial cable having a larger diameter of the coaxial cable, to the improved receptacle 1 of the invention which is not the fitting seat.

Further, the NF type connector having a male contact pin to which the cable conductor is connected can be connected by inserting the pin into the receptacle 1, through screwing the connector to the threaded portion 9b of the plug 9.

As has been described, according to the invention, there is provided a receptacle 1 which is adaptable, thanks to the first and second contact regions Q1,Q2 capable of exerting supporting forces in orthogonal directions and superior restoring and resilient forces, to a large variety of sizes of the cable conductors which are usually used. In addition, this receptacle can be used broadly in combination with various types of coaxial cables, by forming a male screw 9c in the large-diameter flange 9' of the plug 9 by which the receptacle 1 is received, and by preparing an adapter 12 having the first and second female screws 12,12b.

What is claimed is:

1. A connector for connecting coaxial cables comprising an axial extending wall member which is comprised of a first element folded over on itself to form a fold defining one terminating end of said wall member, said wall member having a first section and a second section, said first section being defined by opposed and abutting portions of said first element and extending from said fold to said second section, said second section having opposed and spaced portions of said first element and extending from said first section to the other terminating end of said wall member, said opposed and spaced portions of said second section of said wall member having means thereon defining a first lip between which said coaxial cable passes, said opposed and spaced portions of said second section of said wall member having generally parallel side edges, a pair of elements disposed generally perpendicular to said opposed and spaced portions of said second section of said wall member, said pair of elements each having a first part disposed on said side edges and a second part extending axially beyond said other terminating end of said wall member, said second part of said pair of elements being spaced from one another and having means thereon defining a second lip between which said coaxial cable passes, said second lip being axially spaced from said first lip.

2. A connector according to claim 1, wherein said means defining said second lip comprises generally V-shaped end portions on said pair of elements.

3. A connector according to claim 2, wherein said pair of elements have arcuate portions extending from said V-shaped end portions.

4. A connector according to claim 2, wherein said pair of elements have straight portions extending from said V-shaped end portions.

5. A connector according to claim 2, wherein said V-shaped end portions extend generally transversely across each of said pair of elements, and means defining a notch in each of said V-shaped end portions in which said coaxial cable is accommodated.

6. A connector according to claim 2, wherein said means defining said first lip comprises generally V-shaped end parts on said opposed and spaced portions of said second section of said wall member.

7. A connector according to claim 2, wherein said means defining said first lip comprises a generally V-shaped end part on one of said pair of opposed and spaced portions of said second section of said wall member, the other one of said pair of opposed and spaced portions of said second section of said wall member being generally straight.

8. A connector according to claim 7, wherein said other of said pair of opposed and spaced portions of said second section of said wall member is generally parallel to said first section of said wall member, said one of said pair of said spaced portions of said second section of said wall member being constructed to converge towards said other of said pair of spaced and opposed portions of said second section of said wall member.

9. A connector according to claim 8, wherein said opposed and spaced portions of said second section of said wall member defining said first lip are spaced from one another during the normal non-cable connecting and non-flexed state.

10. A connector according to claim 1, wherein said first element is formed from a generally flat web material.

11. A connector according to claim 1, wherein said pair of elements are each formed from a generally flat web material.

* * * * *